United States Patent [19]

Schmidt

[11] Patent Number: 4,650,374

[45] Date of Patent: Mar. 17, 1987

[54] APPARATUS FOR DRIVING PIPES THROUGH THE GROUND

[76] Inventor: Paul Schmidt, Reiherstrasse 1, 5940 Lennestadt-Saalhausen, Fed. Rep. of Germany

[21] Appl. No.: 751,082

[22] Filed: Jul. 2, 1985

[30] Foreign Application Priority Data

Jul. 18, 1984 [DE] Fed. Rep. of Germany ..... 3426374

[51] Int. Cl.[4] ..... F16L 1/00; B25D 17/08

[52] U.S. Cl. ..... 405/184; 173/128; 173/132; 403/334; 403/368

[58] Field of Search ..... 405/132, 134, 138, 154, 405/184, 245; 254/29 R; 173/78, 80, 90, 128, 131–133; 279/19; 175/19, 20, 53, 62; 403/333, 334, 368, 369, 371

[56] References Cited

U.S. PATENT DOCUMENTS

| | | | |
|---|---|---|---|
| 1,769,169 | 7/1930 | Thornley | 173/132 X |
| 1,894,446 | 1/1933 | McKenny | 173/132 X |
| 1,948,707 | 2/1934 | Gilman | 405/184 |
| 2,325,565 | 7/1943 | Williams | 405/184 |
| 2,534,809 | 12/1950 | Brown | 173/128 X |
| 2,902,832 | 9/1959 | Levy et al. | 405/184 X |
| 3,742,718 | 7/1973 | Weiss et al. | 405/184 |
| 4,462,468 | 7/1984 | Jenne | 173/131 X |

FOREIGN PATENT DOCUMENTS

| | | | |
|---|---|---|---|
| 3112395 | 10/1982 | Fed. Rep. of Germany . | |
| 962460 | 9/1982 | U.S.S.R. | 173/132 |

*Primary Examiner*—Cornelius J. Husar
*Assistant Examiner*—Nancy J. Stodola
*Attorney, Agent, or Firm*—Toren, McGeady and Goldberg

[57] ABSTRACT

In an apparatus for driving open-ended pipes through the ground, a hollow intermediate piece having a truncated conical transition portion with outlet openings for the removal of soil, which is forced into the pipe during driving, is disposed between the rearward end of the pipe and a pneumatic rammer for driving the pipe.

6 Claims, 2 Drawing Figures

APPARATUS FOR DRIVING PIPES THROUGH THE GROUND

This invention relates to apparatus for driving open-ended pipes, such as protective ducts or pipelines through the ground.

BACKGROUND OF THE INVENTION

The driving of steel pipes through the ground, for example with the help of a pneumatic rammer which has a part-conical driving nose engaging directly or via a driving cap into the rearward end of the pipe, which is guided on bearing blocks and has a driving shoe fitting over both the inside and the outside of the forward end, has become increasingly common. Since the driven pipe is open at its forward end, that is at the driving shoe, the soil through which the pipe is driven penetrates during driving further and further into the interior of the pipe, while the driving shoe compacts the soil surrounding the pipe. Because the driving shoe has a larger external diameter than that of the pipe, it creates a channel in the soil, through which the driven pipe moves forwards under the impact of the rammer with comparatively low wall friction.

As the interior of the pipe becomes increasingly filled with soil as driving advances, the soil friction against the inner face of the pipe also increases. This occurs particularly when the soil inside the pipe becomes more and more compacted under the influence of the driving impacts and of the soil being forced into the pipe from its forward end. Furthermore, the soil inside the pipe has to be accelerated with the forward movement of the pipe. Because of this an additional consumption of total energy by the rammer results. Moreover, the soil must from time to time be removed from the driven pipe. A number of techniques for removing the soil from the interior of the pipe are known. Thus, for example, the soil can be removed from the pipe interior by means of a screw conveyor within the pipe. This, however, like the flushing out of the soil with high-pressure water, requires the expense of additional equipment and is accompanied by considerable interruptions in driving. In another technique for removing the soil from the pipe interior, after driving has been terminated a thrust disc which bears sealingly against the inner face of the wall of the pipe is fitted into the forward end of the pipe and the interior of the pipe in front of the disc is subjected to compressed air, in order to force the soil counter to the direction of driving out of the pipe by movement of the thrust disc along the pipe under the air pressure. This technique is also complicated and expensive and moreover can only be used for short pipe lengths and with low frictional resistance, on account of the friction of the soil against the inner face of the wall of the pipe.

OBJECT OF THE INVENTION

The main object of the present invention is to provide an apparatus for driving a pipe through the ground, the apparatus, with low expenditure on equipment, making possible continuous driving and continuous removal of the soil from the interior of the pipe.

SUMMARY OF THE INVENTION

To this end, according to this invention, apparatus for driving an open-ended pipe through the ground comprises a driving member, means for applying a driving force to the member, and an intermediate piece disposable between the rearward end of the pipe and the driving member, the intermediate piece having at least one outlet opening for soil passing through the pipe and having an external conical face for engaging in the pipe end and a truncated conical transition portion tapering from the external diameter of the pipe towards the external diameter of the driving member, the outlet opening or openings being disposed in the truncated conical transition portion.

Preferably, the external diameter of the transition portion decreases from approximately the external diameter of the pipe to approximately the external diameter of the driving member. In this way a space is created behind the end of the pipe, into which the soil can emerge from the pipe. The intermediate piece may be a hollow member, which is closed at its rear adjacent the driving member and which is seated on the rear end of the pipe and against the rear of which the driving member is fitted.

The soil can emerge through the outlet opening or openings disposed in the truncated conical transition portion, so that continuous driving and continuous removal of the soil from the interior of the pipe are assured. The truncated conical transition portion constitutes a guide device acting outwardly and in the direction towards the outlet openings. Moreover, for a pipe of large diameter, a driving member of smaller diameter may be used, without requiring special adapter pieces. An intermediate piece having an external conical face engaging in the pipe end, an internal conical surface serving as seating for a driving member on a striking nose on a pneumatic rammer and the truncated conical portion connecting the two conical faces together, has proved especially successful. With the external conical face engaging in the pipe end, the driving force of the rammer is transmitted to the pipe without damage to the pipe end, and variations in the internal diameter of the pipe are compensated by the varying depth of penetration of the external conical face into the pipe. The striking nose of the rammer engaging into the internal conical face serves as the closure of the rear end of the intermediate piece, so that the guiding of the soil by the truncated conical portion in the intermediate piece towards the outlet openings is assured.

SHORT DESCRIPTION OF THE DRAWINGS

An example of an apparatus in accordance with the invention is illustrated in the accompanying drawings, in which:

FIG. 1 is a side view of the apparatus and of a pipe being driven by the apparatus; and, FIG. 2 is a sectional side view to a larger scale of part of the apparatus and of the rear end of the pipe.

DESCRIPTION OF THE PREFERRED EMBODIMENT

Figure 1:
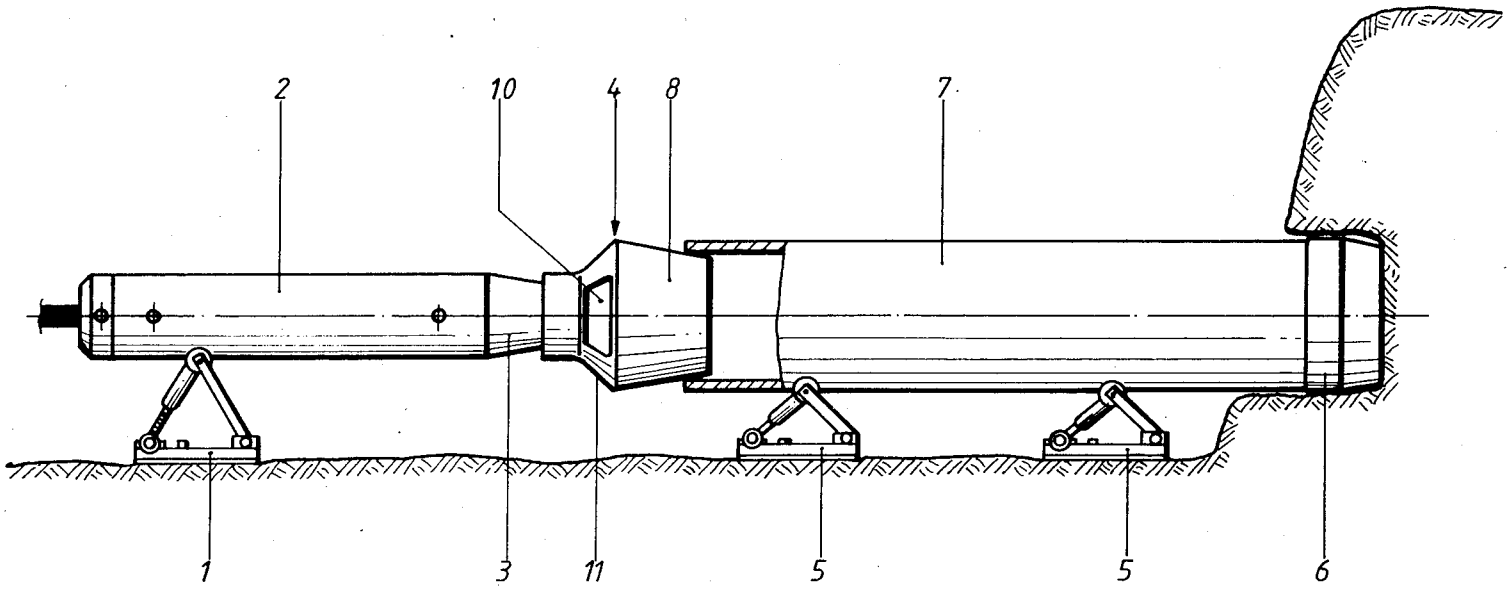
Figure 2:
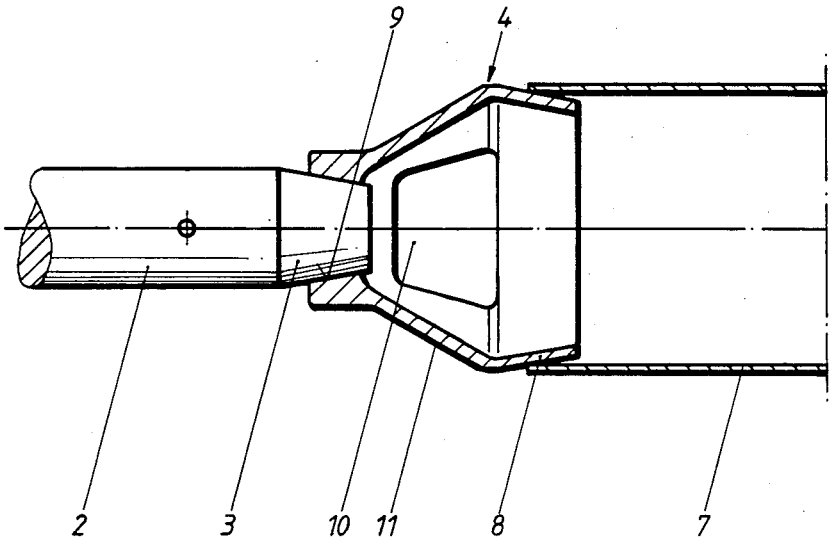

In horizontal driving, a pneumatic driving ram 2, which is guided on a bearing block 1, has a striking nose 3 which engages via an intermediate piece 4 into the rearward end of a pipe 7. The pipe 7 is guided on bearing blocks 5 and is provided at its forward end with a driving shoe 6. The intermediate piece 4 is, as shown in FIG. 2, of tubular construction and has at its forward end an external cone 8, which engages in the rearward end of the pipe, and also an internal cone 9 for receiving the striking nose 3. Between the external cone 8 and the internal cone 9, there is a truncated conical transition portion 11, the diameter of which decreases from approximately the internal diameter of the pipe to approximately the diameter of the driving nose of the ram 2. In the transition portion 11, there are outlet openings 10. The soil which is forced into the interior of the pipe during driving is guided by the truncated conical transition portion 11, acting as guide device, to outlet openings 10 and emerges from these openings backwards out of the intermediate piece 4 into space behind the external cone 8, without interfering with the forward driving of the pipe 7.

A pipe, not shown, for the supply of lubricant may lead to the driving shoe 6, this lubricating pipe being connected to outlet ducts in the driving shoe. A lubricating liquid conveys the soil, which is rendered low in friction by the lubricant, outwards out of the pipe interior. By means of the supply of lubricating liquid, the consistency of the soil and thus the soil friction inside the pipe can be reduced virtually as much as desired and simultaneously the removal of the soil through the pipe interior and the outlet openings 10 in the intermediate piece 4 can be considerably facilitated. Depending upon the local circumstances, the soil penetrating into the interior of the pipe can be converted into a pasty or even a liquid state. This is mainly a question of the ratio of the quantity of liquid supplied to the quantity of soil in each individual case.

I claim:

1. In apparatus for driving an open-ended pipe through the ground, said apparatus including a driving member having a forward end, means for applying a driving force to said driving member, an axially extending hollow intermediate piece disposable between a rear end of said pipe and the forward end of said driving member, and at least one outlet opening in said intermediate piece for the outlet of soil passing through said pipe, wherein the improvement comprises that said intermediate piece comprises a first axially extending section having a first end and a second end with the first end arranged to fit into a rearward end of said pipe and the second end located between said pipe and said driving member, a second axially extending section having a first end and a second end with the first end engaging the second end of the first axially extending section and the second end located adjacent the forward end of said driving member, said first section has an axially extending coinically shaped outer surface diverging outwardly from the first end to the second end thereof, said second section has an axially extending inner surface and an axially extending outer surface each converging inwardly from the first end thereof to the second end of said second section, said at least one outlet opening located in said second section between the first and second ends thereof, and said intermediate section includes a third axially extending section extending from the second end of said second section and arranged to receive the forward end of said driving member.

2. Apparatus as claimed in claim 1, wherein said second section has an external diameter at the first end thereof substantially equal to the external diameter of said rearward end of said pipe and the external diameter of the second end of said second section is substantially equal to the external diameter of said driving member.

3. Apparatus as claimed in claim 1, wherein said third section has an axially extending conically shaped inner surface diverging in the direction axially from said second section and forming a seat for the forward end of said driving member.

4. Apparatus as claimed in claim 1, wherein the diameter of the first end of said second section is approximately the same as the internal diameter of said pipe and the diameter of the second end of said second section is approximately the diameter of the forward end of said driving member.

5. Apparatus as claimed in claim 4, wherein the first end of said first section has a diameter smaller than the inside diameter of said pipe so that said first section extends for a portion of the axial length thereof into said pipe with the second end of said first section spaced axially outwardly from the rearwardly end of said pipe.

6. Apparatus as claimed in claim 5, wherein said outlet opening extends in the circumferential direction and in the axial direction of said second section from the first end thereof toward the second end thereof and said outlet opening having a pair of circumferentially extending edges and a pair of axially extending edges with said circumferentially extending edges disposed in generally parallel relation and said axially extending edges converging toward one another in the direction from the first end toward the second end of said second section.

* * * * *